US010874222B2

(12) United States Patent
Adams

(10) Patent No.: US 10,874,222 B2
(45) Date of Patent: Dec. 29, 2020

(54) READY TO ASSEMBLE FURNITURE

(71) Applicant: Ashley Furniture Industries, Inc., Arcadia, WI (US)

(72) Inventor: Brian Adams, Eau Claire, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 16/138,468

(22) Filed: Sep. 21, 2018

(65) Prior Publication Data

US 2019/0090646 A1 Mar. 28, 2019

Related U.S. Application Data

(60) Provisional application No. 62/562,163, filed on Sep. 22, 2017.

(51) Int. Cl.

| | |
|---|---|
| ***A47C 7/42*** | (2006.01) |
| ***A47C 1/14*** | (2006.01) |
| ***A47C 5/04*** | (2006.01) |
| ***B65D 5/50*** | (2006.01) |
| ***A47C 5/10*** | (2006.01) |
| ***A47C 17/02*** | (2006.01) |
| ***A47C 7/02*** | (2006.01) |

(Continued)

(52) U.S. Cl.

CPC ..... *A47C 7/42* (2013.01); *A47C 1/14* (2013.01); *A47C 5/043* (2013.01); *A47C 5/10* (2013.01); *A47C 7/021* (2013.01); *A47C 11/00* (2013.01); *A47C 17/02* (2013.01); *B65D 5/5002* (2013.01); *A47C 4/02* (2013.01)

(58) Field of Classification Search

CPC ..... A47C 5/043; A47C 5/10; A47C 7/021; A47C 17/02; A47C 4/02; A47C 7/42; A47C 11/00; A47C 1/14; B65D 5/5002

USPC ..... 297/440.23, 440.15

See application file for complete search history.

(56) References Cited

U.S. PATENT DOCUMENTS

| | | | |
|---|---|---|---|
| 77,608 | A | 5/1868 | Hall |
| 126,009 | A | 4/1872 | Beidler |
| 477,421 | A | 6/1892 | Jaekel |

(Continued)

FOREIGN PATENT DOCUMENTS

| | | | |
|---|---|---|---|
| EP | 1199010 | A3 | 4/2002 |
| FR | 1399355 | A | 6/1964 |

(Continued)

*Primary Examiner* — Syed A Islam

(74) *Attorney, Agent, or Firm* — Christensen, Fonder, Dardi & Herbert PLLC

(57) ABSTRACT

A ready-to-assemble ("RTA") sofa suitable for outdoor use comprising a seat base and a back rest that can be reconfigured between a use configuration in which the sofa has a conventional L-shaped cross-section and a shipping or storage configuration in which the sofa is arranged in a more efficiently stacked rectangular cross-section. The rectangular cross-section allows the sofa to be more efficiently stacked with other sofas during shipping or storage. In addition, the rectangular cross-section reduces the dead spaces created when an L-shaped sofa is inserted into a box that can collapse during shipping or storage. Moreover, providing a single rigid integral component, the seat base, as an internal skeletal component, provides vertical support extending substantially the height of the box at the opposing ends, provides a highly robust boxed package.

18 Claims, 6 Drawing Sheets

(51) Int. Cl.
*A47C 11/00* (2006.01)
*A47C 4/02* (2006.01)

(56) References Cited

U.S. PATENT DOCUMENTS 607,905 A 7/1898 Wyngaard
638,466 A 12/1899 Kelly
781,999 A 2/1905 Bullard
803,826 A 11/1905 Holmes et al.
823,879 A 6/1906 Kindel et al.
863,874 A 8/1907 Rajner
988,721 A 4/1911 Kroehler
1,044,059 A 11/1912 Kroehler
1,265,705 A 5/1918 Litchfield
1,278,491 A 9/1918 Metzger
1,297,714 A 3/1919 Metzger
1,303,613 A 5/1919 Svebilius
1,360,478 A 11/1920 Wajtukiewicz
1,403,423 A 1/1922 Le Duc
1,424,302 A 8/1922 Helms
1,456,800 A 5/1923 Headley
1,855,130 A 4/1932 Appleby
2,261,506 A 9/1940 Scott
2,217,426 A 10/1940 Zareko
2,229,608 A 1/1941 Ragsdale et al.
2,279,864 A 4/1942 Eide
2,334,912 A 11/1943 Eide
2,350,640 A 6/1944 Rorke
2,364,012 A 11/1944 Walton et al.
2,418,731 A 4/1947 Seitz
2,452,642 A 11/1948 Ewing
2,531,045 A 11/1950 Hoffman
2,532,863 A 12/1950 Taylor
2,545,243 A 3/1951 Rumsey, Jr.
2,589,372 A 3/1952 Hake
2,620,024 A 12/1952 Rietman
2,650,656 A 9/1953 Ohlsson
2,660,228 A 11/1953 Reinhold
2,692,007 A 10/1954 Christian
2,703,136 A 3/1955 Masse
2,705,528 A 4/1955 Friedlander
2,705,995 A 4/1955 McMurtry
2,738,834 A 3/1956 Jaffe et al.
2,744,266 A 5/1956 Kaehn
2,755,846 A 7/1956 Shepherdson
2,796,919 A 6/1957 Ginsberg
2,825,101 A 3/1958 Rubenstein
2,829,707 A 4/1958 Liebson
2,854,062 A 9/1958 Hetchler
3,001,822 A * 9/1961 Pagliaro ..... A47C 4/08 297/381
3,003,817 A 10/1961 King
3,030,146 A * 4/1962 Faxon ..... A47C 4/028 297/411.45
3,061,165 A 10/1962 Rench et al.
3,082,435 A 3/1963 Philips et al.
3,083,889 A 4/1963 Christensson
3,099,482 A 7/1963 Woodruff, Sr.
3,104,132 A 9/1963 Entwistle
3,104,913 A 9/1963 Faulkner et al.
3,132,910 A 5/1964 Vigna
3,170,729 A 2/1965 Grant
3,204,255 A 9/1965 Scholz
3,379,474 A 4/1968 Schwarz, Jr.
3,439,951 A 4/1969 Wright
3,458,966 A 8/1969 Dunbar et al.
3,458,996 A 8/1969 Mixon, Jr. et al.
3,467,433 A 9/1969 Lindau et al.
3,540,776 A 11/1970 Wilson
3,594,056 A 7/1971 Sager
3,601,176 A 8/1971 Savickas
3,608,959 A 9/1971 Sarvas
3,632,150 A 1/1972 Milakovich
3,640,576 A 2/1972 Morrison et al.
3,643,997 A 2/1972 Gilbert et al.
3,645,550 A 2/1972 Biehl
3,650,563 A 3/1972 Hansson et al.
3,658,382 A 4/1972 Anderson
3,677,601 A 7/1972 Morrison et al.
3,680,916 A 8/1972 Gilbert et al.
3,695,690 A 10/1972 Carson
3,695,702 A 10/1972 Ingellis
3,704,911 A 12/1972 Milakovich
3,726,561 A 4/1973 Bolyos
3,731,956 A 5/1973 Hanley
3,747,743 A 7/1973 Hoffmann, Jr.
3,752,533 A 8/1973 Gilbert
3,754,585 A 8/1973 Clark
3,774,966 A 11/1973 Faulkner et al.
3,778,175 A 12/1973 Zimmer
3,799,611 A 3/1974 Steinfeld
3,844,612 A 10/1974 Borggren et al.
3,870,366 A 3/1975 Rogers
3,873,154 A 3/1975 Baker, Jr.
3,882,557 A 5/1975 Stehlik
3,883,104 A 5/1975 Delafield
3,929,375 A 12/1975 Gans
3,945,627 A 3/1976 Simon
3,951,558 A 4/1976 Komarov
3,952,463 A 4/1976 Lane
3,966,340 A 6/1976 Morris
3,973,800 A 8/1976 Kogan
3,982,352 A 9/1976 Branson
3,989,298 A 11/1976 Cycowicz et al.
4,025,216 A 5/1977 Hives
4,030,846 A 6/1977 Flötotto
4,036,371 A 7/1977 Michel
4,055,924 A 11/1977 Beaver, Jr.
4,077,517 A 3/1978 Hilemn
4,078,842 A 3/1978 Zur
4,079,995 A 3/1978 Beckley
4,108,489 A 8/1978 Salzman
4,124,201 A 11/1978 Burton
4,139,919 A 2/1979 Simon
4,140,065 A 2/1979 Chacon
4,146,269 A 3/1979 Beckley
4,165,902 A 8/1979 Ehrlich
4,184,608 A 1/1980 Christensson
4,204,287 A 5/1980 Lane et al.
4,209,198 A 6/1980 Apple, Sr.
4,225,265 A 9/1980 Hooker et al.
4,234,976 A 11/1980 Litkewycz
4,236,460 A 12/1980 Poupko
4,305,616 A 12/1981 Martinez
4,343,509 A 8/1982 Lundgren
4,354,331 A 10/1982 Dyke
D268,465 S 4/1983 Bergguist et al.
4,378,609 A 4/1983 Patterson et al.
4,389,759 A 6/1983 Yuda
4,418,514 A 12/1983 Spann
4,422,195 A 12/1983 Russo et al.
4,466,675 A 8/1984 Ferdinand et al.
4,481,684 A 11/1984 Hauck
4,519,107 A 5/1985 Dillon et al.
4,521,928 A 6/1985 Stephenson
4,523,344 A 6/1985 Stumpf et al.
4,523,787 A * 6/1985 Robinson ..... A47C 4/028 297/440.1
D279,628 S 7/1985 DeFuccio
4,549,863 A 10/1985 Bourgeois
4,555,821 A 12/1985 Page
4,563,037 A 1/1986 Tiffany
4,575,886 A 3/1986 Larson
4,577,816 A 3/1986 Foster
4,586,205 A 5/1986 Stevens
4,588,227 A * 5/1986 Austin ..... A47C 4/022 297/440.24
4,593,950 A 6/1986 Infanti
4,601,621 A 7/1986 Permoda
4,621,381 A 11/1986 Schramek
4,630,550 A 12/1986 Weitzman
4,632,459 A 12/1986 Herschlag
4,675,929 A 6/1987 Santo
4,679,260 A 7/1987 Frettem

(56) References Cited

U.S. PATENT DOCUMENTS 4,697,847 A 10/1987 Herschlag
4,700,920 A 10/1987 Horn
4,711,492 A 12/1987 Asbjornsen et al.
4,711,495 A * 12/1987 Magder ..... A47C 4/028 297/452.52
4,743,068 A 5/1988 Gomes
4,751,625 A 6/1988 Lin
4,755,000 A 7/1988 Chiaro et al.
4,788,727 A 12/1988 Liu
4,803,742 A 2/1989 Rasnick et al.
4,820,269 A 4/1989 Riddell
4,828,324 A 5/1989 Putnam
4,841,586 A 6/1989 Juster et al.
4,848,839 A 7/1989 Galardo
4,868,941 A 9/1989 Tai
4,869,564 A 9/1989 Lechman
4,879,775 A 11/1989 Keefer
4,881,779 A 11/1989 Bubien
4,883,317 A 11/1989 Davenport
4,886,326 A 12/1989 Kuzyk
4,893,958 A 1/1990 Wieland
4,895,352 A 1/1990 Stumpf
4,919,485 A 4/1990 Guichon
4,925,244 A 5/1990 Nava
4,925,245 A 5/1990 Pendleton et al.
4,928,337 A 5/1990 Chauncey
4,932,720 A 6/1990 Sherman
4,934,756 A 6/1990 Webb et al.
5,000,512 A 3/1991 Laird
5,007,681 A 4/1991 Meier et al.
5,069,506 A 12/1991 Wieland
5,076,390 A 12/1991 Haskins
5,080,438 A 1/1992 Moyer
5,112,110 A 5/1992 Perkins
5,115,526 A 5/1992 Boyd
5,115,924 A 5/1992 König
5,135,284 A 8/1992 Crum
5,171,064 A 12/1992 Boussaroque
5,184,871 A 2/1993 LaPointe et al.
5,222,286 A 6/1993 Saul et al.
5,236,114 A 8/1993 Bergquist
5,263,764 A 11/1993 Laughlin et al.
5,263,766 A 11/1993 McCullough
5,265,939 A 11/1993 Self et al.
5,288,126 A 2/1994 Saul et al.
5,301,413 A 4/1994 Habegger et al.
5,303,976 A 4/1994 Nobile et al.
5,314,234 A 5/1994 England
5,317,768 A 6/1994 Klancnik
5,318,346 A 6/1994 Roosien et al.
5,318,348 A 6/1994 Hess
5,323,526 A 6/1994 Saul et al.
5,329,654 A 7/1994 Sherman
5,338,095 A 8/1994 Laughlin et al.
5,352,017 A 10/1994 Berning
5,358,309 A 10/1994 Fedele
5,394,573 A 3/1995 Laughlin et al.
5,407,250 A 4/1995 Prince et al.
5,415,461 A 5/1995 Sakamoto
5,418,989 A 5/1995 Roe
5,423,591 A 6/1995 LaPointe et al.
5,423,596 A 6/1995 Laughlin et al.
5,427,431 A 6/1995 Saul et al.
5,435,621 A 7/1995 Komorowski et al.
5,444,905 A 8/1995 St. Clair
5,469,589 A 11/1995 Steed et al.
5,471,725 A 12/1995 Thrasher
5,473,785 A 12/1995 Lager et al.
5,499,414 A 3/1996 Dillon
5,501,541 A 3/1996 Gomes
5,507,563 A * 4/1996 Arthur, Jr. ..... A47C 4/02 297/440.23
5,529,380 A * 6/1996 Blansett ..... A47C 4/02 297/440.23
5,536,078 A 7/1996 Novikoff
5,540,481 A 7/1996 Roossien et al.
5,551,757 A 9/1996 Glover
5,553,443 A 9/1996 St. Clair et al.
5,557,813 A 9/1996 Steed et al.
5,562,274 A 10/1996 Kitchen et al.
5,564,141 A 10/1996 Anderson
5,570,927 A 11/1996 LaPointe et al.
5,570,930 A 11/1996 LaPointe et al.
5,572,853 A 11/1996 St. Clair et al.
5,575,023 A 11/1996 McCumber
5,601,340 A * 2/1997 Stout ..... A47C 4/02 297/440.1
5,605,378 A 2/1997 Oyediran
5,613,287 A 3/1997 St. Clair
5,621,935 A 4/1997 St. Clair
5,622,030 A 4/1997 Steed et al.
5,624,160 A 4/1997 Koch et al.
5,630,643 A 5/1997 Scholten et al.
5,649,742 A * 7/1997 Liu ..... A47C 3/00 297/440.22
5,655,812 A 8/1997 Albecker, III
5,662,381 A 9/1997 Roosien et al.
5,671,492 A 9/1997 Simon
5,671,974 A 9/1997 Boycott et al.
5,678,897 A * 10/1997 Prestia ..... A47C 4/02 297/440.15
5,681,090 A 10/1997 St. Thomas
5,689,844 A 11/1997 Liu
5,695,244 A 12/1997 Gillern et al.
5,704,085 A 1/1998 Sabalaskey
5,709,500 A 1/1998 Mizelle et al.
5,720,093 A 2/1998 Yoder, Jr.
5,738,414 A 4/1998 Wieland et al.
5,749,133 A 5/1998 Mauldin et al.
5,768,724 A 6/1998 Buell
5,775,778 A 7/1998 Riley et al.
5,803,739 A 9/1998 Hitchcock
5,842,264 A 12/1998 Roossien et al.
RE36,142 E 3/1999 Steed et al.
5,878,470 A 3/1999 Blansett
5,890,767 A 4/1999 Chang
5,901,505 A 5/1999 Dettmann et al.
5,911,478 A 6/1999 Goodman
5,940,908 A 8/1999 Gladney
5,954,620 A 9/1999 Albritton
5,974,993 A 11/1999 DeFranks et al.
5,987,678 A 11/1999 Ayers
5,988,755 A 11/1999 Fastelli et al.
6,000,079 A 12/1999 Dranger
6,068,331 A 5/2000 Barnes
6,070,941 A 6/2000 Chung
6,098,224 A 8/2000 Gladney
6,108,982 A 8/2000 Davison
6,217,120 B1 4/2001 Pugliese
6,224,159 B1 * 5/2001 Perry ..... A47C 1/032 297/411.42
6,241,317 B1 * 6/2001 Wu ..... A47C 4/02 297/440.1
6,243,900 B1 6/2001 Gladney et al.
6,257,153 B1 7/2001 Portugal
6,263,532 B1 7/2001 Miller
6,267,446 B1 7/2001 Wieland et al.
6,279,997 B1 8/2001 Moore et al.
6,293,624 B1 9/2001 Gaylord et al.
6,308,354 B1 10/2001 Lilly et al.
6,347,835 B1 2/2002 LaPointe et al.
6,367,874 B2 4/2002 Casini
6,408,469 B2 6/2002 Gladney et al.
6,422,654 B1 * 7/2002 Grove ..... A47C 7/42 297/440.1
6,493,887 B1 12/2002 DeFranks et al.
6,519,798 B2 2/2003 Gladney et al.
6,523,900 B1 2/2003 Conner et al.
6,557,198 B1 5/2003 Gladney et al.
6,561,047 B1 5/2003 Gladney et al.
6,568,014 B1 5/2003 Sabalaskey et al.
6,568,058 B1 5/2003 Wieland et al.
6,586,071 B1 7/2003 Hanes
6,595,592 B1 7/2003 Wieland et al.

(56) References Cited

U.S. PATENT DOCUMENTS 6,616,239 B2 9/2003 Guillot
6,619,749 B2 9/2003 Willy
6,637,812 B2 10/2003 Laughlin et al.
6,666,518 B2 12/2003 Bruschi et al.
6,678,905 B2 1/2004 Gladney et al.
6,687,929 B2 2/2004 DeFranks et al.
6,688,699 B1 2/2004 Bowie
6,692,079 B2 2/2004 Guillot
6,695,408 B1 2/2004 Nobbe
6,702,389 B2 3/2004 Hall, Jr. et al.
6,702,391 B1 3/2004 Stipek
6,715,837 B2 4/2004 Niederman et al.
6,718,726 B1 4/2004 Kuchel et al.
6,725,523 B2 4/2004 Chiang
6,758,450 B2 * 7/2004 Niederman ..... A47C 4/02 248/200
6,772,463 B2 8/2004 Gladney et al.
6,772,530 B2 8/2004 Nennig
6,773,063 B2 8/2004 Eerkens
6,779,845 B1 8/2004 Lin et al.
6,783,182 B1 8/2004 Gallagher
6,792,819 B2 9/2004 Gladney et al.
6,799,344 B2 10/2004 Gladney et al.
6,804,849 B2 10/2004 Van Patten
6,807,912 B2 10/2004 Willy
6,839,950 B2 1/2005 Guillot
6,866,913 B2 3/2005 Hanes
6,931,685 B2 8/2005 Kuchel et al.
6,934,981 B2 8/2005 Waldman et al.
6,942,298 B2 9/2005 Harrison
6,944,899 B2 9/2005 Gladney
6,944,900 B2 9/2005 Van Patten
6,981,747 B2 1/2006 Wieland et al.
6,983,499 B2 1/2006 Gladney
6,984,057 B1 1/2006 Rogers
D517,844 S 3/2006 Gladney
7,017,205 B2 3/2006 Gladney
7,017,254 B2 3/2006 Guillot
7,036,173 B2 5/2006 Gladney
7,044,557 B2 5/2006 Wieland
7,047,581 B2 5/2006 Gladney
7,073,756 B1 7/2006 Walton
7,086,108 B1 8/2006 Litvak
7,096,528 B2 8/2006 Gladney et al.
7,103,933 B2 9/2006 Gladney et al.
7,140,690 B2 11/2006 White et al.
7,165,282 B2 1/2007 Watson
7,168,117 B2 1/2007 Gladney et al.
7,168,766 B2 1/2007 Pelletier
7,171,706 B2 2/2007 Piretti
7,174,583 B2 2/2007 Hofmann
7,174,613 B2 2/2007 DeFranks et al.
7,178,868 B2 2/2007 Richardson et al.
7,200,884 B2 4/2007 Wright et al.
7,213,885 B2 5/2007 White, III et al.
7,219,381 B2 5/2007 Damewood et al.
7,219,962 B2 5/2007 Stone
7,240,967 B2 * 7/2007 Wade ..... A47C 4/02 297/440.1
7,252,273 B2 8/2007 Lewellen et al.
7,252,339 B2 8/2007 Owens
7,255,403 B2 8/2007 Butler
D551,011 S 9/2007 Van Patten
D551,012 S 9/2007 Van Patten
D552,397 S 10/2007 Van Patten
7,278,683 B2 10/2007 Williams et al.
7,296,584 B2 11/2007 Goldwitz
7,314,252 B2 1/2008 Ohliv et al.
7,370,380 B2 5/2008 DeFranks et al.
7,370,914 B2 5/2008 Newman
7,395,568 B2 7/2008 Damewood
7,418,753 B2 9/2008 Kuchel et al.
7,419,220 B2 9/2008 White, III et al.
7,424,762 B2 9/2008 Wright et al.
7,424,763 B2 9/2008 Gladney
7,434,304 B2 10/2008 Owens
7,438,362 B2 10/2008 Dotta et al.
7,444,706 B2 11/2008 Gladney et al.
7,458,641 B2 12/2008 Wang
7,480,947 B2 1/2009 Patella
7,510,244 B1 3/2009 Shin
7,520,370 B2 4/2009 Gudim
7,523,989 B2 4/2009 Wieland et al.
7,540,568 B2 * 6/2009 Behrens ..... A47C 3/00 297/42
7,547,073 B2 6/2009 White, III et al.
7,568,767 B2 8/2009 Richardson
7,574,763 B2 8/2009 Gladney et al.
7,581,271 B2 9/2009 Gladney et al.
7,587,775 B2 9/2009 DeFranks et al.
7,624,464 B2 12/2009 Gladney et al.
7,644,991 B2 1/2010 Davis et al.
7,681,945 B1 3/2010 Wiecek et al.
7,690,096 B1 4/2010 Gladney et al.
7,708,345 B2 * 5/2010 Grabowski ..... A47C 7/14 297/354.12
7,708,346 B2 5/2010 White et al.
7,731,291 B2 6/2010 Wang
7,744,161 B2 6/2010 Berg et al.
7,744,162 B2 * 6/2010 Griggs, Jr. ..... A47C 4/02 297/440.14
7,748,066 B2 7/2010 Gladney
7,757,340 B2 7/2010 Sawalski
7,758,119 B1 7/2010 Baterdouk
7,758,128 B2 7/2010 Schwartz
D621,197 S 8/2010 Gladney et al.
7,775,590 B2 8/2010 Shen
7,814,594 B2 10/2010 DeFranks et al.
7,827,637 B2 11/2010 DeFranks
7,849,542 B2 12/2010 DeFranks
7,866,200 B1 1/2011 Winer et al.
7,922,253 B2 4/2011 Chen
7,930,780 B2 4/2011 Clenet
7,963,612 B2 6/2011 Nelson
7,988,236 B2 8/2011 Brandtner
7,992,240 B2 8/2011 Gladney
7,997,651 B2 8/2011 Shen
8,001,639 B2 8/2011 Gladney et al.
8,006,529 B2 8/2011 DeFranks et al.
8,033,231 B2 10/2011 DeFranks et al.
D651,250 S 12/2011 Gross et al.
D651,443 S 1/2012 Wightman
8,099,811 B2 1/2012 Gladney et al.
8,104,839 B2 * 1/2012 Huang ..... A47C 4/03 297/440.1
8,112,868 B2 2/2012 Miller
D655,938 S 3/2012 Kozel
D655,965 S 3/2012 Schachte
D656,196 S 3/2012 Gross et al.
D656,197 S 3/2012 Gross et al.
8,127,383 B2 3/2012 Gladney et al.
D659,413 S 5/2012 Arko et al.
8,181,293 B2 5/2012 DeFranks et al.
D661,925 S 6/2012 DeFranks et al.
D662,338 S 6/2012 Arko et al.
8,197,003 B2 6/2012 Rogers
8,225,726 B1 7/2012 Fineberg
8,250,689 B2 8/2012 Gladney
RE43,754 E 10/2012 Andersen
D669,726 S 10/2012 Wightman
D670,126 S 11/2012 Price
D670,127 S 11/2012 Price
D670,128 S 11/2012 Price
D670,129 S 11/2012 Price
D670,130 S 11/2012 Price
D670,948 S 11/2012 Price
D670,949 S 11/2012 Price
D670,950 S 11/2012 Price
D670,951 S 11/2012 Price
D670,952 S 11/2012 Price
D670,953 S 11/2012 Price
8,307,482 B2 11/2012 Gladney et al.
8,322,792 B2 12/2012 Chen

(56) References Cited

U.S. PATENT DOCUMENTS 8,322,793 B2 * 12/2012 Chen ..... A47C 4/02 297/440.1
D673,413 S 1/2013 Price
8,353,072 B2 1/2013 Klancnik
8,356,372 B2 1/2013 Smalling et al.
8,356,954 B2 * 1/2013 Koch ..... F16B 21/09 403/353
8,359,985 B2 1/2013 Wangdak
8,366,200 B2 2/2013 Schwartz
D677,965 S 3/2013 Tjoflat
8,403,421 B2 3/2013 Wang
D680,358 S 4/2013 Tjoflat
8,408,653 B2 4/2013 Griggs, Jr.
8,414,732 B2 4/2013 DeFranks
8,429,776 B2 4/2013 Klancnik et al.
D681,980 S 5/2013 DeFranks
D683,992 S 6/2013 Gladney
8,474,805 B2 7/2013 DeFranks et al.
8,480,179 B2 7/2013 Griggs, Jr.
8,490,231 B1 7/2013 Tjoflat
D688,491 S 8/2013 Wightman
8,511,752 B2 8/2013 Grove
8,544,959 B2 10/2013 Mackert
8,590,976 B2 11/2013 Davis
D696,530 S 12/2013 Bradford
8,646,843 B2 2/2014 Koch
8,667,908 B2 3/2014 Martin et al.
8,684,466 B2 4/2014 Blair
8,689,705 B2 4/2014 Martin et al.
8,701,882 B2 4/2014 Voissem
D707,469 S 6/2014 Wightman
8,745,795 B2 6/2014 Klancnik
8,764,114 B1 7/2014 Frank et al.
8,764,115 B2 7/2014 Brandtner
8,777,319 B2 * 7/2014 Brandtner ..... A47C 4/02 297/440.15
8,783,778 B2 7/2014 Nelson et al.
8,806,672 B1 8/2014 Raymond et al.
D717,079 S 11/2014 Bradford
8,919,883 B2 12/2014 Hankins et al.
8,950,817 B2 2/2015 Iacovoni et al.
9,004,585 B1 4/2015 Pidgornyy
9,022,473 B2 5/2015 Crum
9,028,003 B2 * 5/2015 Yeh ..... A47C 17/02 297/440.14
9,039,106 B2 5/2015 Riley
D731,819 S 6/2015 Wightman
9,078,515 B2 7/2015 Keragala
D737,076 S 8/2015 Wightman
9,155,394 B1 10/2015 Cohen
9,185,974 B2 11/2015 Martin et al.
9,210,999 B2 12/2015 Martin et al.
9,241,571 B2 1/2016 Robertson
9,241,575 B2 1/2016 Wang
9,277,813 B2 3/2016 Nelson et al.
9,277,826 B2 3/2016 Nelson et al.
9,334,891 B2 5/2016 Richey
9,345,330 B2 5/2016 Andrade
D758,763 S 6/2016 Bradford
9,380,877 B2 7/2016 Brandtner et al.
9,402,384 B2 8/2016 Weber, Jr.
9,402,481 B2 8/2016 Weber, Jr.
9,468,298 B2 10/2016 Gerstle
9,474,381 B2 10/2016 Brandtner et al.
9,480,338 B2 11/2016 Griggs, Jr.
9,512,866 B2 12/2016 Gerstle
9,512,867 B2 12/2016 Gerstle
9,538,855 B2 1/2017 Gross et al.
9,538,857 B2 1/2017 Klancnik
D782,221 S 3/2017 Wightman
9,615,663 B2 4/2017 Davis
9,635,945 B2 5/2017 Smithwick et al.
9,668,581 B1 6/2017 Hill
9,839,299 B2 * 12/2017 Wang ..... A47C 31/00
10,251,485 B2 * 4/2019 Sewell ..... A47C 4/028
2002/0000740 A1 1/2002 Laughlin et al.
2003/0151293 A1 8/2003 McLarty et al.
2004/0021359 A1 2/2004 Chang
2004/0078896 A1 4/2004 Hellyer et al.
2004/0090094 A1 5/2004 Williams et al.
2004/0095000 A1 5/2004 Durling
2004/0118792 A1 6/2004 Herring
2004/0155509 A1 8/2004 Smith, Jr.
2004/0160109 A1 8/2004 Bottemiller
2005/0005353 A1 1/2005 Waldman et al.
2005/0006943 A1 1/2005 Wieland
2005/0067876 A1 3/2005 Dortch
2005/0088028 A1 4/2005 Wan et al.
2005/0179303 A1 8/2005 Owens et al.
2005/0194030 A1 9/2005 Goldwitz
2005/0194031 A1 9/2005 Goldwitz
2005/0225153 A1 10/2005 Ou
2005/0264050 A1 12/2005 Richardson et al.
2005/0285012 A1 12/2005 Walton
2006/0033368 A1 2/2006 Longnecker
2006/0048301 A1 3/2006 Klancnik et al.
2006/0061154 A1 3/2006 Kahan
2006/0061191 A1 3/2006 Pelletier
2006/0186722 A1 8/2006 Butler
2006/0208553 A1 9/2006 Ohliv et al.
2006/0265969 A1 11/2006 Broderick
2007/0024102 A1 2/2007 Wang
2007/0052276 A1 3/2007 Hurvich
2007/0108814 A1 5/2007 Grabowski et al.
2007/0108823 A1 5/2007 Grabowski et al.
2007/0114830 A1 5/2007 Newman
2007/0267248 A1 11/2007 Gudim
2007/0294137 A1 12/2007 Zett
2008/0012410 A1 1/2008 Chang
2008/0012416 A1 1/2008 Richey
2008/0030054 A1 2/2008 Williams et al.
2008/0035194 A1 2/2008 Goldwiz
2008/0157571 A1 7/2008 Richardson
2008/0231089 A1 9/2008 LaPointe et al.
2008/0252130 A1 10/2008 Wieland et al.
2008/0276839 A1 11/2008 Louis et al.
2008/0301927 A1 12/2008 Miller
2008/0309145 A1 12/2008 Brandtner
2009/0016807 A1 1/2009 Koch
2009/0045667 A1 2/2009 Wang
2009/0056779 A1 3/2009 Goldwitz
2009/0076932 A1 3/2009 Tung
2009/0146481 A1 6/2009 Fernandez Perez
2009/0278387 A1 11/2009 Barbosa
2009/0293927 A1 12/2009 Goldwitz
2010/0007190 A1 1/2010 Johnson et al.
2010/0008744 A1 1/2010 Tseng et al.
2010/0040410 A1 2/2010 King et al.
2010/0096898 A1 4/2010 Senephimmachack
2010/0224521 A1 9/2010 Voissem
2010/0244536 A1 9/2010 Chen
2010/0244537 A1 9/2010 Chen
2010/0264715 A1 10/2010 Griggs, Jr.
2010/0270843 A1 10/2010 Wang
2010/0270844 A1 * 10/2010 Hood ..... A47C 7/42 297/440.15
2011/0101763 A1 5/2011 Chen
2012/0102656 A1 5/2012 Klancnik
2012/0146382 A1 6/2012 Griggs, Jr.
2012/0187737 A1 7/2012 Blair
2012/0217784 A1 8/2012 Griggs, Jr.
2012/0248836 A1 10/2012 Lejcher et al.
2013/0174344 A1 7/2013 Klancnik et al.
2013/0175057 A1 7/2013 Klancnik
2013/0216299 A1 8/2013 Furnes
2014/0143953 A1 5/2014 Blair
2014/0252819 A1 9/2014 Andrade
2015/0042132 A1 2/2015 Weber, Jr.
2015/0089890 A1 4/2015 McLoughlin et al.
2015/0223606 A1 8/2015 Gerstle
2015/0230612 A1 8/2015 Weber, Jr.
2016/0106219 A1 4/2016 Stirling

(56) References Cited

U.S. PATENT DOCUMENTS

| | | | |
|---|---|---|---|
| 2016/0258458 | A1 | 9/2016 | Gerstle |
| 2017/0000265 | A1 | 1/2017 | Gross et al. |

FOREIGN PATENT DOCUMENTS

| | | | |
|---|---|---|---|
| WO | WO2001058314 | | 8/2001 |
| WO | WO2009071040 | A1 | 6/2009 |

* cited by examiner

READY TO ASSEMBLE FURNITURE

CROSS-REFERENCE TO RELATED APPLICATION

This application claims the benefit of U.S. Provisional Application No. 62/562,163, filed Sep. 22, 2017, the disclosure of which is hereby incorporated by reference in its entirety.

FIELD OF THE INVENTION

The present invention is directed to a ready to assemble sofa suitable for outdoor use that can be reconfigured between a use configuration and a shipping or storage configuration, wherein the shipping or storage configuration defines a more regular and compact shape for more efficient shipping or storage of multiple sofas, and the seat base provides a conforming skeletal structure for the packaged RTA sofa.

BACKGROUND OF THE INVENTION

Furniture items used for seating typically comprise a support structure with cushions for supporting the user's back and bottom. In particular, sofas typically comprise a seat base, a back rest, and at least one arm rest. A common aesthetic and practical design consideration is assembling the subcomponents of the sofa with minimum gaps between the subcomponents to avoid strain on the fasteners and the aesthetically unpleasing appearance of the gaps. Accordingly, furniture items are typically fully assembled at the factory to ensure that the individual subcomponents are properly assembled with minimal interspatial gaps.

The inherent drawback of assembling furniture at the factory is that the common L-shape of the assembled seating furniture typically prevents efficient packing of the furniture items for transport. Depending on the shape and size of the furniture item, the packing of the furniture item can result in a significant amount of dead space within the shipping container or truck. In addition to increasing the cost of transportation, the dead space can allow the furniture items to shift during transport resulting in safety risks, uneven weight distributions, or damage to the furniture item. Although the furniture item can be boxed for shipment, the L-shaped cross-section creates portions of the box that are unsupported and likely to collapse, damaging the box and underlying furniture item. Providing additional support within the box with supplemental packaging materials to address these issues is expensive, increases the weight of the packaged sofa, and reduces margins.

An approach to addressing the drawbacks of factory assembled outdoor furniture items comprises providing individual subcomponents as a ready to assemble furniture kit. The individual components can be more efficiently packed and the furniture item is able to be assembled in situ or dissembled for off season storage. However, the inherent challenge of providing ready to assemble furniture kits is that the consumers who assemble the furniture kits are typically untrained and may not have ready access to the tools or training necessary to properly assemble the subcomponents. In addition, aligning the bulky and awkward subcomponents to install the fasteners for connecting the subcomponents can be difficult and tedious, particularly if a single individual is assembling the furniture item. If the fasteners are not properly installed the structural integrity of the furniture item could be compromised resulting in collapse and/or injury of users.

As such, there is a need for a means of providing furniture that does not suffer from the drawbacks of factory assembled furniture and currently available ready to assemble outdoor furniture kits. In ready to assemble furniture, it is advantageous to limit the number of components that need to be assembled, to reduce the number of required fasteners, to provide structural elements that enhance the stability of the packaged product without affecting the aesthetic quality of the furniture, to provide decorative features to hide interspatial gaps, to have the assembly be simple, and to provide the smallest possible shipping package and storage configuration.

SUMMARY OF THE INVENTION

The present invention is directed to a ready-to-assemble ("RTA") sofa suitable for outdoor use comprising a seat base and a back rest that can be reconfigured between a use configuration in which the sofa has a conventional L-shaped cross-section and a shipping or storage configuration in which the sofa is arranged in a more efficiently stacked rectangular cross-section. The rectangular cross-section allows the sofa to be more efficiently stacked with other sofas during shipping or storage. In addition, the rectangular cross-section reduces the dead spaces created when an L-shaped sofa is inserted into a box that can collapse during shipping or storage. Moreover, providing a single rigid integral component, the seat base as an internal skeletal component, providing vertical support extending substantially the height of the box at the opposing ends, provides a highly robust boxed package.

Specifically, the seat base, having front, back, left, and right sides, is a rigid integral framework of rectangular metal tubing welded together. The seat base may be formed of aluminum rectangular tubing. The seat base further comprises a pair of armrests, a left armrest and a right armrest, each armrest having an inverted U-shape, the left armrest being welded to the rectangular seat base framework at the left side and the right armrest being welded on the right side of the seat base framework, each armrest comprising a downward rearward leg portion, a downward forward leg portion, an upper rearward portion, a generally horizontal portion and an upper forward portion. The seat base further comprises at least one intermediate leg formed of metal tubing welded to the rectangular seat base framework at the back side positioned in-between the left side and right side, each of the at least one leg having an upwardly extending post portion with a first mating portion extending upwardly from the rectangular seat base framework. "Sofa" used herein includes a loveseat which is generally considered having two seating positions.

The back rest has a rectangular back rest framework with a top frame member, a lower frame member, a left side frame member and a right side frame member. Each of the left and right side frame members are welded to the top frame member and the lower frame member. The back rest further has one or more columns with a post portion welded to and extending downwardly from the lower frame member. Each column has a second mating portion configured to abuttingly mate with the first mating portion of the upwardly extending post portion to form an abutted juncture when assembled. The back rest may be formed from aluminum rectangular tubing with the entirety of the back rest integral and rigid. In some embodiments, a ring welded to the at least one leg hides this abutted juncture from view once the structure is fully assembled. Once assembled, with one of the first and second mating portions having a socket and the other of the first and second mating portions having a post conforming to the socket, the back rest is constrained from tipping forward, backward, or laterally. Each of the one or more back rest columns is secured to the upward extending post with a fastener. This fastener, in conjunction with welds at key stressor points in seat base leg, creates a firm connection between the back rest and seat base able to support the force of multiple users simultaneously leaning against the back rest. The left side frame member is connectable to the left side armrest. The right side frame member is connectable to the right side arm rest. These fasteners provide further structural stability and prevent the back rest from moving in any direction.

In an embodiment of the invention, a boxing rectilinear profile is defined by the fixed base and arm rests with the back rest removed. All other components are fitable in the rectilinear profile in a box. In some embodiments, the other components are the back rest, seat cushions, back rest cushions, assembly hardware, and instructions.

A feature and advantage of embodiments is that a box in which the RTA sofa is contained conforms at its ends to the inverted U-shaped armrests of the seat base.

A feature and advantage of embodiments is a back rest that attaches by an intermediate downwardly extending column portion that engages an upwardly extending intermediate leg portion at a socket connection whereby there is no freedom of movement of the backrest except an upwardly disconnect motion. The connection may be secured by a threaded fastener. In embodiments the downwardly extending column portion engages an upwardly facing tubing end portion attached to the seat base rectangular framework.

A feature and advantage of certain embodiments of the invention is that the components may be shipped in a smaller box than the conventional box, compared to other ready to assemble designs that provide a comparably sized finished sofa. Another feature and advantage of certain embodiments of the invention is that assembly requires fewer fasteners compared to other ready to assemble designs that are considerably more difficult for the user to assemble and lack the structural integrity inherent in this invention's design.

BRIEF DESCRIPTION OF THE DRAWINGS

The invention can be completely understood in consideration of the following detailed description of various embodiments of the invention in connection with the accompanying drawings, in which.

DETAILED DESCRIPTION

Figure 1:
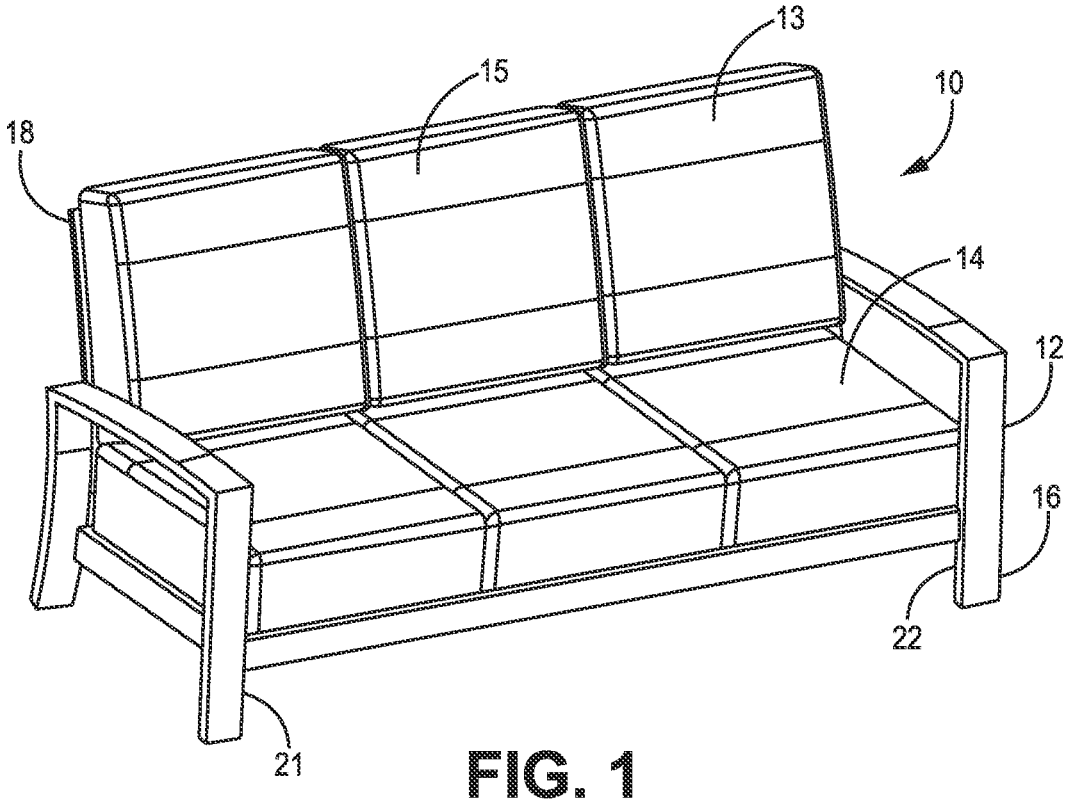
FIG. 1 is a front perspective view of an RTA sofa according to embodiments of the invention.
Figure 2:
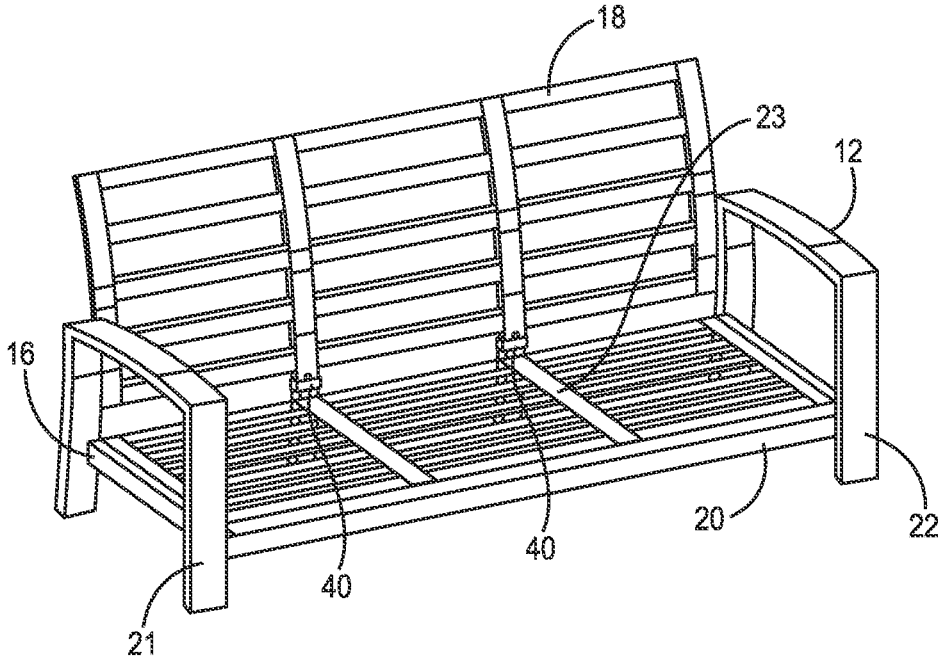
FIG. 2 is a front perspective view of a sofa frame of the sofa of FIG. 1 in a use position according to an embodiment of the present invention.
Figure 3:
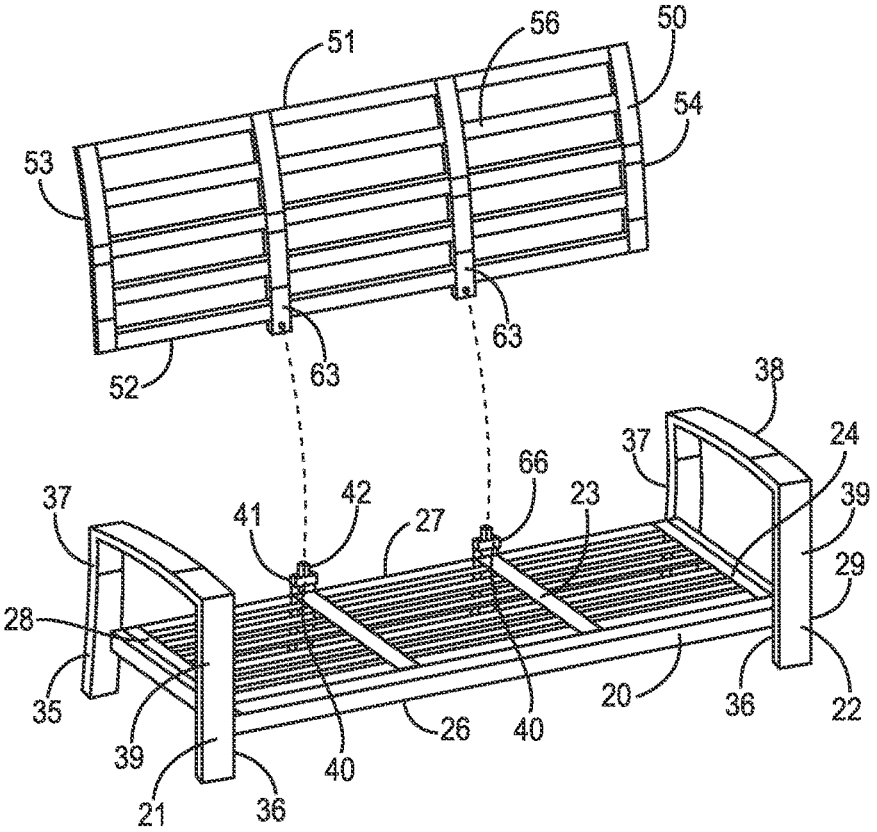
FIG. 3 is an exploded view of a sofa frame into its back rest and its seat base portion according to an embodiment of the present invention.

Referring to FIG. 1, an assembled RTA sofa 10 having a sofa frame 12 and a cushion system 13. In the embodiment, the cushion system comprises a plurality of seat cushions 14 and a plurality of back rest cushions 15. The cushion system could also be a single cushion with a fold between seat portions and back rest portions. Referring to FIGS. 1-3, the frame 12 of the sofa, in embodiments, comprises a seat base 16, and a back rest 18 removably connectable thereto. The seat base 16 having a seat base rectangular framework 20, with integral arm rests 21, 22. "Integral" in that they are fixed together at the factory with permanent fasteners welds, or otherwise, may have common frame members, and they are not detachable from one another without damage. The seat base 16 having a rectangular footprint with a rigid integral platform 23 having a top side 24 for receiving cushion(s), a bottom side 26, a back side 27, a left side 28, and a right side 29. The seat base 16, in embodiments, formed of rectangular metal tubing welded together, for example aluminum or steel.

In embodiments, the armrests 21, 22, each having an inverted U-shape, the left armrest 21 being welded to the seat base rectangular framework 20 at the left side 28 and the right armrest 22 being welded on the right side 29. Each armrest comprises a downward rearward leg portion 35, a downward forward leg portion 36, an upper rearward portion 37, a horizontal portion 38 and an upper forward portion 39 formed of metal tubing welded together. The horizontal portion being the arm engagement portion of the arm rest.

Referring to FIGS. 3-7, the seat base 16 further comprises at least one intermediate leg 40 positioned in between the left side and right side of the seat base 16. The intermediate leg formed of metal tubing welded to the rectangular seat base framework 20 at the back side 27 positioned in-between the left side 28 and right side 29, each of the at least one intermediate leg 40 having a first mating portion 41 configured as an open rectangular tubing end face and a joining portion configured as an upwardly extending post portion 42, extending upwardly from a passageway in the rectangular tubing. The post portion 42 may be permanently secured within the intermediate leg 40 through a series of welds 43. In the illustrated embodiment, two intermediate legs are present. In a loveseat configuration, a single intermediate leg may be appropriate.

Figure 4:
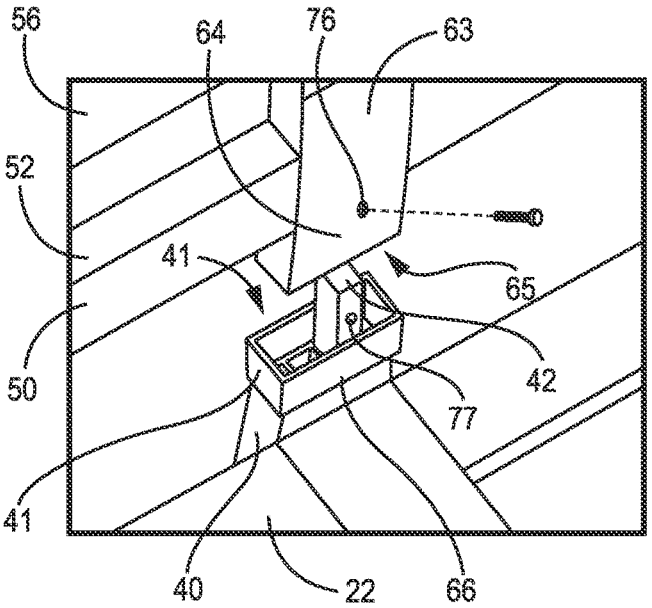
FIG. 4 is a close-up view of the connection made between the back rest column and the seat base column according to an embodiment of the present invention.
Figure 5:
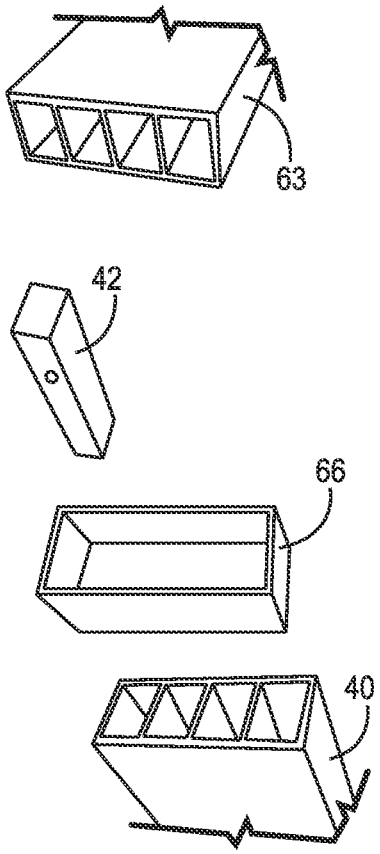
FIG. 5 is an exploded view of the components of the connection of FIG. 4.
Figure 6:
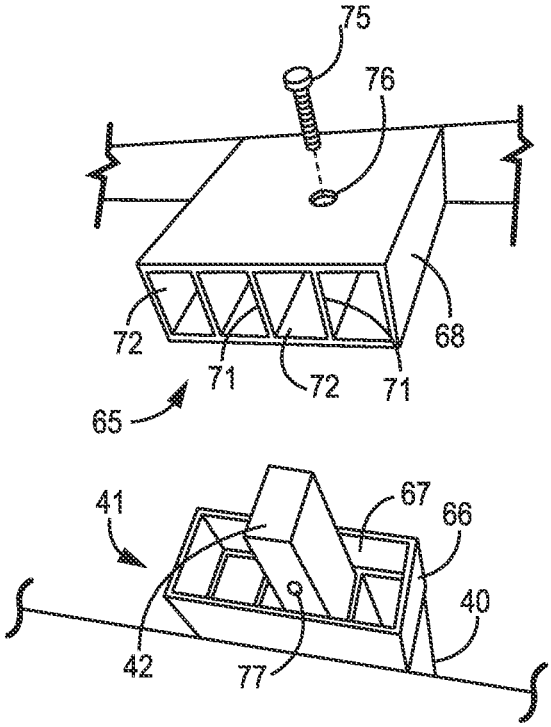
FIG. 6 is another perspective view of the connection of FIG. 4.
Figure 7:
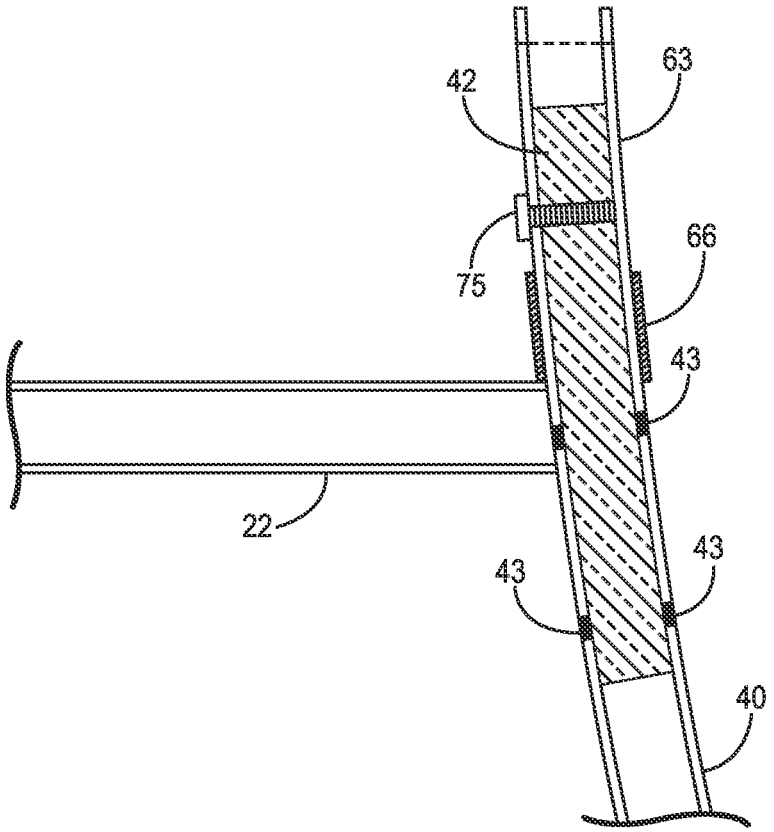
FIG. 7 is a cross-sectional view through a column with the back rest and the seat base portion securely fastened in a use configuration according to an embodiment of the present invention.

As best shown in FIGS. 3-5, the back rest 18 comprises a rectangular back rest framework 50 with a top frame member 51, a lower frame member 52, a left side frame member 53 and a right side frame member 54, each of the left side frame member 53 and the right side frame member 54 welded to the top frame member 51 and the lower frame member 52. The framework supporting rigid integral webbing 56 for receiving one or more back rest cushions 15.

The back rest 18 further having at least one intermediate column portion 63 that includes post portion 64 welded to and extending downwardly from the lower frame member 52. Each column portion 63 having a second mating portion configured to abuttingly mate with the first mating portion of the intermediate leg to form an abutted juncture when assembled. The second mating portion 65 comprising the open rectangular tubing end face of the intermediate column portion. In some embodiments, a joining member comprising a ring 66 welded to the at least one intermediate leg 40 hides this abutted juncture from view once the structure is fully assembled and functions as a socket 67 for engaging the exterior surface 68 of the intermediate column portion. The rectangular tubing of the intermediate portion and intermediate leg may have internal dividers 71 that defined a plurality of passageways 72 in the tubing. The post 42 may be conformingly received in such a passageway. A fastener 75 passes through a bore 76 and into a threaded receiving connection 77 to securely fasten the upper intermediate column portion 63 with the post 42 extending up from the intermediate leg 40.

Figure 8:
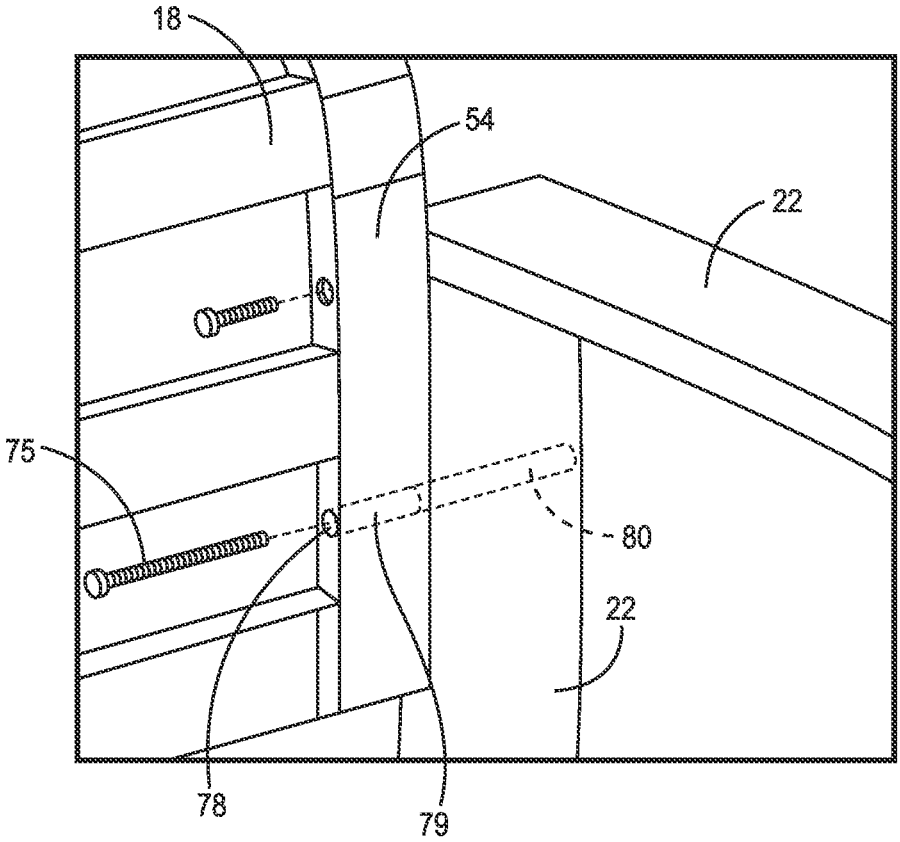
FIG. 8 is a close-up view of the connection made between the back rest and an arm rest according to an embodiment of the present invention.

Referring to FIG. 8, the right side frame member 54 of the back rest 18 contains bores 78 allowing a fastener 75 to secure the right side frame member 54 to the right arm rest 22 when in a use configuration. Similarly, the left side frame member 53 of the back rest 18 contains bores allowing a fastener to secure the left side frame member 53 to the left arm rest 21. Welded-in bushings 79 and threaded nuts 80, inside the rectangular metal tubing of the frame members provide support and a threaded connection for the fasteners.

Figure 9:
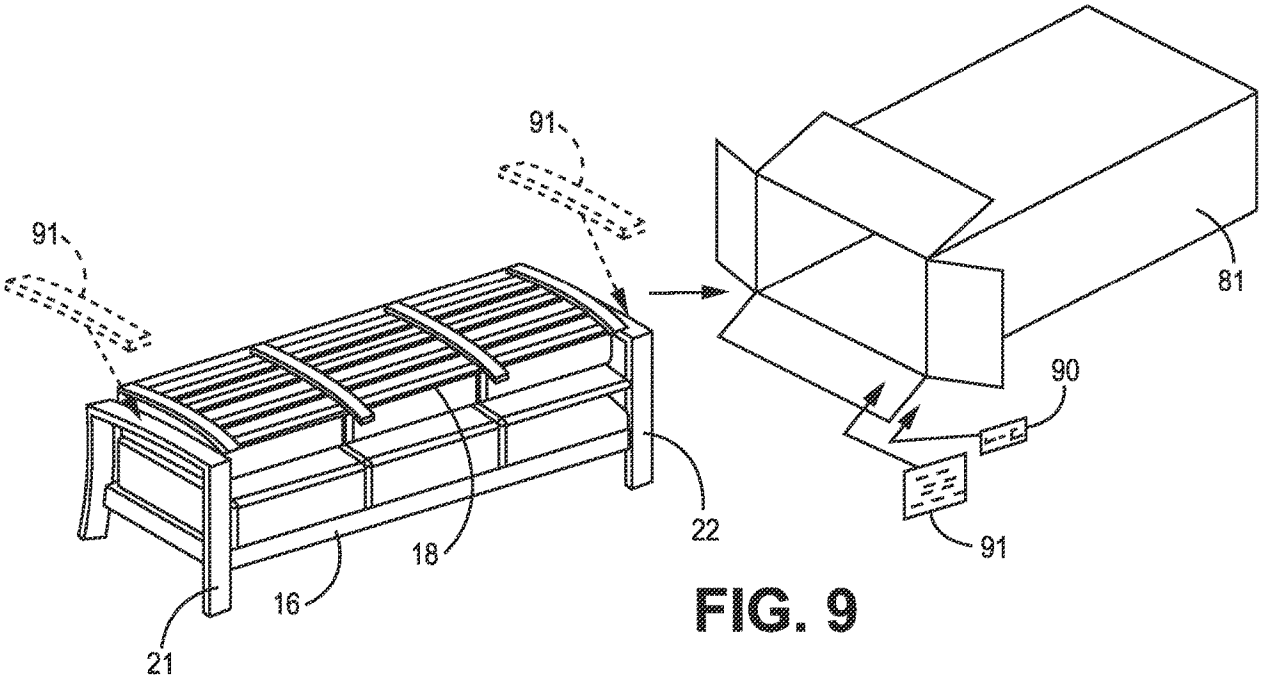
FIG. 9 is a perspective view of a sofa according to an embodiment of the present invention in a shipping configuration being loaded into or pulled from a box.
Figure 11:
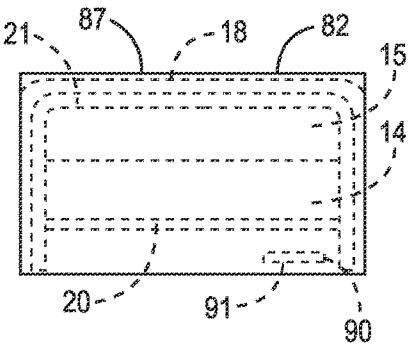
FIG. 11 is an end view of a boxed RTA sofa according to embodiments.
Figure 10:
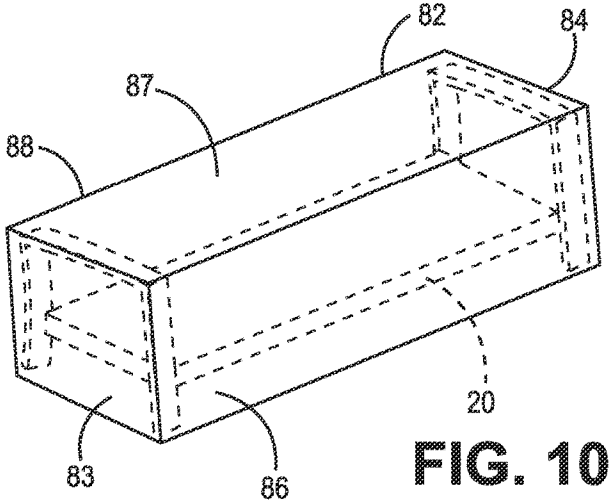
FIG. 10 is a perspective view of a boxed RTA sofa according to embodiments.

As depicted in FIGS. 9-11, in an embodiment, the sofa, including a loveseat, may have a shipping configuration wherein the sofa 10 is arranged into parallel piped configuration having essentially a rectangular cross section that fits into a cardboard box 81. In the shipping configuration, the seat cushions 14 fit on the seat base 16 between the left and right arm rests 21, 22. Further, the back rest cushions 15 lay atop the seat cushions 14 and also fit between the left and right arm rests 21, 22. In the shipping configuration, the back rest 18 lays horizontally across the back rest cushions 61 and between the left and right arm rests 53, 54. The inverted U-shaped arm rests, rigidly attached to one another by way of the seat base framework 20, provide an endoskeleton for the packaged RTA 82. In particular, both ends 83, 84 of the packaged RTA have rectangular metal tubing shaped to conform to the end outline of the box; specifically the front side 86, the top side 87, and the rear side 88 of the box. This substantially provides all the necessary support when multiple boxes are stacked. Where appropriate spacers 91 may be laid on the tops of the inverted U-shaped arm rests to bring the support level to exactly or near the inside surface of the cardboard box. Additionally, the back rest 18 may provide spanning support under the top side of the cardboard box, further increasing the load carrying capacity and essentially eliminating dead space underneath the top layer of the box. The back rest may be supported by the cushions, providing some resiliency at the top of the cardboard box. The cushions may be compressed, for example, by bagging them and evacuating the air from the bags as is known in the art.

Packaged fasteners 90 and instructions 91 may be installed in the boxed ready-to-assemble (RTA) sofa 82.

When received by an end user, the user simply removes the contents from the box, places the back rest into the socketed connection(s) at the back of the seat base, and uses fasteners to secure the socketed connection(s) and to fasten the frame members to the arm rest portion of the seat base, and than places the cushions on the assembled seat base and back rest. A minimal number of steps and fasteners assure minimal issues during assembly.

When used herein "substantially" means within 15% of the comparative measurement parameter. U.S. Pat. Nos. 9,241,575; 5,678,897; 6,637,812; and Publications 2012/0248836; 2010/0270844; and 2008/0185897 are incorporated by reference for all purposes.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A boxed ready to assemble sofa suitable for outdoor use, the sofa having a shipping configuration and a use configuration, the boxed RTA sofa comprising:

a cardboard box containing the sofa in the shipping configuration;

a seat base in the box, the seat base having a rectangular footprint with a top side, a bottom side, a back side, a left side, and a right side, the seat base comprising a rectangular seat base framework formed of rectangular metal tubing welded together, a left armrest and a right armrest, each armrest having an inverted U-shape, the left armrest being welded to the rectangular seat base framework at the left side and the right armrest being welded on the right side of the seat base, each armrest comprising a downward rearward leg portion and a downward forward leg portion, each extending downwardly with respect to the rectangular seat base framework, each armrest further comprising an upper rearward portion and an upper forward portion with a horizontal portion extending therebetween, and, the seat base further comprising an intermediate leg formed of metal tubing welded to the rectangular seat base framework at the back side positioned in-between the left side and right side extending downwardly from the rectangular seat base framework and the intermediate leg having an open rectangular tubing end facing upward at or above the rectangular seat base framework, wherein the box conforms to the seat base with a height of the horizontal portion substantially corresponding with an inside height of the box, and a length of the seat base substantially corresponding to the inside length of the box;

a back rest in the box, the back rest having a rectangular back rest framework with a top frame member, a lower frame member, a left side frame member and a right side frame member, each of the left side frame member and the right side frame member welded to the top frame member and the lower frame member, the back rest further having at least one intermediate column portion having an open rectangular tubing end face facing downward when the back rest is assembled to the seat base, the open rectangular tubing end face of the at least one column portion configured to abuttingly mate with the open rectangular tubing end face of the intermediate leg;

at least one joining component for extending between the intermediate leg and the intermediate column when the back rest is assembled to the seat base, the at least one joining component and abutting tubing end faces precluding rotation between the intermediate column and the intermediate leg and constraining the intermediate column with respect to the intermediate leg and seat base forwardly, rearwardly, leftwardly, rightwardly, and downwardly;

plurality of seat cushions and a plurality of back rest cushions in the box;

instructions in the box; and a plurality of fasteners in the box.

2. The sofa of claim 1 wherein the intermediate leg and intermediate column portion are both formed of matching rectangular tubing each with at least one internal divider defining a plurality of parallel passageways each passageway with a rectangular cross section, and wherein the at least one joining component is a rectangular post conforming to and extending between connecting passageways when the back rest is assembled to the seat base.

3. The sofa of claim 1 wherein the upper rearward portion of the armrests are formed of rectangular tubing and the left side frame member and the right side frame member of the back rest are formed of rectangular tubing, and wherein when the back rest is assembled to the seat base, the upper rearward portion of the left armrest has a forward facing surface and the left side frame member of the back rest has a forward facing portion that is flush with the forward facing surface of the left arm rest and the left arm rest and back rest are securable together with one of the plurality of fasteners.

4. The boxed RTA sofa of claim 1, wherein the plurality of back cushions, the plurality of seat cushions, the seat base, and the back rest are in a vertical stack in the box.

5. The boxed RTA sofa of claim 1, wherein the intermediate leg is a first intermediate leg and the seat base further comprises a second intermediate leg formed of metal tubing welded to the rectangular seat base framework at the back side of the rectangular seat base framework and positioned in-between the left side and right side, and wherein the intermediate column portion is a first intermediate column portion and the back rest further comprises a second intermediate column portion, the second intermediate column portion and the second intermediate leg configured to abuttingly mate together whereby there are two intermediate leg and intermediate column portion junctures.

6. The boxed RTA sofa of claim 1, wherein the back rest is removably attachable to the arm rests and columns by a plurality of threaded fasteners.

7. The boxed RTA sofa of claim 1, wherein the back rest is positioned above the seat base and cushions when in the shipping configuration.

8. The boxed RTA sofa of claim 1, wherein the sofa has a shipping configuration and wherein the shipping configuration the seat cushions are stowed in the seat base, and the back rest cushions are stowed atop the seat cushions and between the arm rests, and the back rest is laid horizontally across the back rest cushions.

9. An RTA sofa comprising an integral welded seat base and an integral welded back rest;

the integral welded seat base comprising a single rigid integral component with a plurality of legs welded to a seat base framework, the seat base framework comprising a rigid cushion platform for supporting seat cushions;

the integral welded back rest comprising rigid cushion support webbing;

the integral welded back rest connecting to the integral welded seat base by way of one or two socket connections at a back side of the seat base intermediate left and right sides of the seat base, the back rest further connecting with the seat base with a first fastener extending between the back rest and a left arm rest, and a second fastener extending between the back rest and a right arm rest, the left arm rest and right arm rest each integral with the seat base; and at least one cushion on the connected integral welded back rest and integral welded seat base, wherein the one or two socket connections each have a rectangular tubing portion of the back rest abutting a rectangular tubing portion of the seat portion and a rectangular post is conformingly positioned within both rectangular tubing portions, and wherein the one or two socket connections each have a rectangular tubing portion of the back rest abutting a rectangular tubing portion of the seat portion and a rectangular ring extending around the abutted connection.

10. The RTA sofa of claim 9 wherein the at least one cushion comprises two seat cushion on the rigid platform of the seat base and two cushions against the rigid back rest support webbing.

11. The RTA sofa of claim 9 wherein the integral welded back rest and integral welded seat base comprise rectangular aluminum tubing.

12. The RTA sofa of claim 9 wherein the integral welded back rest is secured to the seat base exclusively at the one or two socket connections and by the first and second fasteners.

13. A method of assembling an RTA sofa comprising:

removing an integral welded seat base, an integral welded back rest, and a plurality of fasteners from a box, the seat base including a plurality of legs welded to a seat base framework;

plugging one or more intermediate column portions of the back rest into corresponding sockets of the seat base, the sockets positioned rearwardly on the seat base and comprising a post portion;

using one or more fasteners to lock each of the one or more intermediate column portions to the back rest by placing each of the one or more fasteners through both the corresponding intermediate column portion and the corresponding post portion;

connecting each of a left positioned back rest frame member to a left side arm rest member of the seat base at two locations with two elongate threaded fasteners, each extending through one of the left positioned back rest frame member and left side arm rest member and into the other of the left positioned back rest frame member and the left side arm rest member;

connecting each of a right positioned back rest frame member to a right side arm rest member of the seat base at two locations with two elongate threaded fasteners, each extending through one of the right positioned back rest frame member and right side arm rest member and into the other of the right positioned back rest frame member and the right side arm rest member; and placing at least one cushion from the box on the seat base and assembled back rest.

14. The method of claim 13 wherein the placing of at least one cushion on the assembled back rest and seat base comprises placing at least two cushions on the seat base and at least two cushions against the back rest.

15. The method of claim 13 wherein the connection of the back rest to the seat base comprise a total of six connections.

16. The RTA sofa of claim 1 wherein the horizontal arm rest portions being arcuate and having a highpoint substantially at the midpoint of the depth of the box.

17. The RTA sofa of claim 1 wherein the majority of the horizontal length of each arm rest portion extends to within 20% of the maximum internal height of the box.

18. The RTA sofa of claim 1 wherein the rigid back rest is positioned at the top of the stacked RTA thereby being positioned for confronting a top cardboard panel of the box.

* * * * *